United States Patent [19]

Goodman et al.

[11] 4,252,450

[45] Feb. 24, 1981

[54] RIBBON DRIVE WITH SPRING-LOADED IDLER

[75] Inventors: L. Neil Goodman, Garland; Charles J. Kubasta, Plano, both of Tex.

[73] Assignee: Xerox Corporation, Stamford, Conn.

[21] Appl. No.: 948,269

[22] Filed: Oct. 3, 1978

[51] Int. Cl.[3] ..... B41J 33/14

[52] U.S. Cl. ..... 400/208; 400/235.1; 226/187

[58] Field of Search ..... 400/194, 195, 196, 196.1, 400/207, 208, 214, 235.1; 226/168, 187

[56] References Cited

U.S. PATENT DOCUMENTS

| | | | |
|---|---|---|---|
| 746,765 | 12/1903 | Warner et al. | 226/187 X |
| 2,597,176 | 5/1952 | Pettus | 226/187 X |
| 3,356,202 | 12/1967 | Goff | 400/208 |
| 3,424,360 | 1/1969 | Trott | 226/168 |
| 3,672,655 | 6/1972 | Carter | 226/187 X |
| 3,831,731 | 8/1974 | Mack et al. | 400/235.1 X |
| 3,904,016 | 9/1975 | Hengelhaupt | 400/214 X |
| 3,960,259 | 6/1976 | Guerrini et al. | 400/208 |
| 3,973,707 | 8/1976 | Pratt et al. | 400/235.1 X |
| 3,974,906 | 8/1976 | Lee et al. | 400/196.1 |
| 3,977,512 | 8/1976 | Teagarden et al. | 400/195 |
| 3,993,182 | 11/1976 | Steinke | 400/195 |
| 4,011,933 | 3/1977 | Kern | 400/208 |
| 4,091,913 | 5/1978 | Ku et al. | 400/196 X |
| 4,091,914 | 5/1978 | Stipanuk | 400/208 X |
| 4,092,921 | 6/1978 | McInnis et al. | 400/196.1 X |

*Primary Examiner*—Ernest T. Wright, Jr.

[57] ABSTRACT

A ribbon drive device comprising a rotatably supported drive roller, a rotatably supported idler roller and a device for biasing the idler roller against the drive roller to form a nip therebetween through which a ribbon is fed. The device for biasing the idler roller is positioned to apply a bias force to the idler roller at the longitudinal center thereof. The device for biasing comprises a straight piece of round or rectangular spring wire positioned in a groove formed in the periphery of the idler roller.

6 Claims, 4 Drawing Figures

RIBBON DRIVE WITH SPRING-LOADED IDLER

BACKGROUND OF THE INVENTION

This invention relates in general to web drive mechanism and in particular to a ribbon drive mechanism for ink ribbons employed in a ribbon cartridge in serial printer applications.

Although the invention is applicable to various web, tape, strand and ribbon-like materials, it has been found particularly useful in the environment of ink ribbons as used in serial printers. Therefore, without limiting the meaning of the word "ribbon," the invention will be described in this environment.

In the particular environment of ink ribbons employed in ribbon cartridges in serial printers, it is normally necessary to provide a ribbon drive means by which force is applied to the ribbon to remove it from the receptacle providing the supply of ribbon. This same ribbon drive means provides the force to move or advance the ribbon past a print position during the printing operation. In most instances, ribbon take-up drive means for the take-up receptacle is required to provide the force necessary to place the ribbon on the receiving receptacle upon its deliverance or transfer from the supply receptacle. In some instances, the ribbon drive means and the ribbon take-up drive means comprise a single means, which performs both functions.

Also, normally a ribbon tension means is provided for maintaining a predetermined amount of tension in the ribbon material during its transfer from the supply receptacle to the take-up receptacle. Tension in the ribbon during its transfer is necessary for proper ribbon feed and ribbon position at the printing station or position to assure acceptable print quality of the printed material.

The amount of ribbon movement for each printing operation is dependent upon the particular pitch chosen and the particular type of ribbon being used. When print quality is of concern, the ribbon used will preferably be either a multi-strike ribbon or a single-strike ribbon. The multi-strike ribbon is designed so that a type font or slug can overstrike the same general area of the ribbon a number of times without loss of print quality. The first time the ribbon is impacted, a predetermined percentage of the ink is released; the next time the ribbon is impacted, another predetermined percentage of the ink is released, etc., until the maximum amount of ink is released from the ribbon without loss of print quality. The function of the ribbon drive is to advance or pull the ribbon the correct increments so that the overstrike area is used to maximum efficiency without loss of print quality. The single-strike ribbon is designed so that one impact by the type slug fractures the ink layer and essentially removes all the ink and transfers the ink from the ribbon to the paper. The next character to be printed must be impacted against a fresh portion of the ribbon. In this case, the ribbon drive must advance the ribbon a sufficient distance such that the next character impacts a fresh portion of the ribbon. It is obvious that the ribbon drive for the single-strike ribbon must advance a greater amount of ribbon per character printed than the driver used for the multi-strike ribbon.

In providing a ribbon drive means to advance the ribbon the desired amount between successive print operations, it is well known in the art to provide a drive roller with pointed projections thereon in conjunction with spring means for applying the drive force to the outer periphery of the ribbon wound on the take-up spool. It is also known to provide a pawl and ratchet arrangement for rotating the spindles, which rotatably support the ribbon supply spool and the ribbon take-up spool. In addition, it is known to provide a drive roller and a cooperating friction or pressure roller to pinch the ribbon therebetween and advance the ribbon as the drive roller or meter is rotated.

Such prior art solutions have utilized complex mechanical means comprising many elements in conjunction with various spring means to provide the necessary control of the drive means to transfer the web or ribbon material from the supply spool to the take-up spool.

With the prior art in mind, it is an object of the present invention to provide an improved ribbon drive means, which is compatible with cartridges of the present type.

Another object of this invention is to provide a cost effective ribbon drive means for ink ribbons contained in cartridges along the presently described type.

Other objects and advantages of this invention will be evident from the specification and claims in conjunction with the accompanying drawing illustrative of the invention.

SUMMARY OF THE INVENTION

In accordance with the principles illustrative of this invention, the foregoing objects and others of the present invention are accomplished by a ribbon drive means comprising a drive roller, an idler roller and means for biasing the idler roller against the drive roller to form a nip therebetween through which the ribbon is fed. The means for biasing the idler roller is positioned to apply a bias force to the idler roller at the longitudinal center thereof. A groove is formed in the periphery of the idler roller at the center of the longitudinal dimension. In the preferred embodiment, the bias means comprises a straight piece of round or rectangular spring wire, which is positioned such that its center portion rests in the groove formed in the idler roller. The ends of the spring are supported in posts such that a tension force is applied to the idler roller by the center portion of the spring. A ribbon guide post is positioned between the ribbon drive means and a ribbon take-up receptacle at a predetermined location to provide and assure that the ribbon exits from the ribbon drive means at a predetermined angle. By applying the bias force to the center of the idler roller, there is equal force distribution from the top to the bottom of the nip area, which results in good tracking and essentially prevents the ribbon from riding up or down with respect to the nip area.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1:
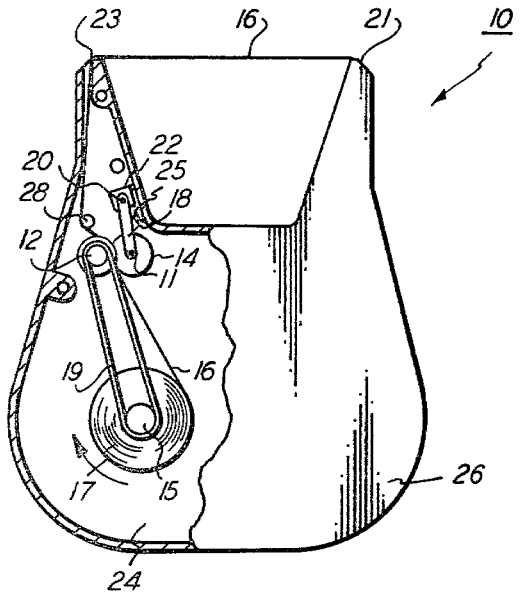
PRIOR ART FIG. 1
FIG. 1 is a fragmentary top plan view showing a ribbon cartridge and ribbon drive constructed in accordance with the prior art.

The prior art ribbon drive means employed in the ribbon cartridge 10 of FIG. 1 comprises drive roller or meter 12 cooperating with an idler pressure roller 14 to form a gripping and rolling action with respect to ribbon 16 passing through the nip formed therebetween. Both the drive roller or meter 12 and the idler pressure roller 14 have teeth or serrations formed on the outer surface of their coacting portions. Drive roller or meter 12 is journaled for rotation in opposing holes in alignment with each other in the bottom cover portion 24 and the top cover portion 26 of ribbon cartridge 10. A flange near the bottom end of drive roller or meter 12 maintains said roller 12 within the ribbon cartridge 10.

Idler pressure roller 14 is journaled for rotation about pin 11, which is supported in one end portion of levers 18 (only one lever 18 being shown since the other lever 18 is directly behind and on the opposite side of roller 14 from the lever 18 which is shown). The other and opposite end portions of levers 18 are supported for pivotal movement about and by pin 20, which is supported by post 22. Spring 25 urges levers 18 in a clockwise direction resulting in the idler pressure roller 14 being forced and held against ribbon 16 passing between the idler pressure roller 14 and the drive roller or meter 12. A star-type or cross-shaped coupling is formed in the bottom end portion of drive roller 12 to mate with the drive shaft of the ribbon drive motor (not shown), which is mounted on the movable carriage (not shown) of a printer (not shown). Guide post 28 projects upwardly in a vertical orientation from the bottom cover portion 24 and is positioned in a location, which provides a constant angle of feed of the ribbon 16 into the nip formed by the drive roller or meter 12 and the idler pressure roller 14.

The ribbon take-up receptacle comprises shaft 15 with integral hub 17 about which the ribbon 16 is wound subsequent to passing beyond the ribbon drive means. Shaft 15 includes a cylindrical opening (not shown) for receiving in relatively rotatable relation a fixed shaft (not shown) projecting upwardly from the bottom cover portion 24. Shaft 15 extends through an opening in the top cover portion 26 with an annular groove formed in the portion of the shaft 15 extending above the top cover portion 26. O-ring 19 fits into the annular groove in shaft 15 and extends in a stretched condition to a similar groove formed in the top portion of drive roller or meter 12, which extends above the top cover portion 26.

Regarding ribbon path, the ribbon 16 passes from the ribbon supply means (not shown) located in the right-hand portion of ribbon cartridge 10 and out an opening in horn 21, across the open space between horns 21 and 23 and then into an opening in horn 23. Once back inside the ribbon cartridge 10, the ribbon 16 passes around the outboard of guide post 28 and then into the nip formed by drive roller or meter 12 and idler pressure roller 14. From said nip, ribbon 16 passes to and around hub 17 upon which it is wound.

In operation, the ribbon drive means intermittently pulls the ribbon 16 from the ribbon supply means (not shown) thereby providing a fresh portion of ribbon 16 at the print station (located approximately midway between horns 21 and 23) for the printing operation. Upon initiation of a print command for the printer, the ribbon drive motor (not shown) is activated causing the drive roller or meter 12 to rotate. Idler pressure roller 14 is biased toward the drive roller or meter 12 by spring 25 causing a gripping of the ribbon 16 and subsequent movement of the ribbon 16 toward the ribbon take-up receptacle by the rotation of the drive roller or meter 12. The ribbon 16, which is fed through the ribbon drive means, must be wound upon hub 17. This is accomplished by O-ring 19 as it couples the movement of the drive roller 12 to shaft 15 and integral hub 17. As drive roller or meter 12 is rotated to feed ribbon 16 toward hub 17, the hub 17 is correspondingly rotated, due to O-ring 19, to take up any slack in the ribbon 16 and wind the ribbon 16 onto hub 17. As the diameter of the wound ribbon 16 on the hub 17 increases, the O-ring 19 is designed to start slipping about shaft 15, thereby permitting hub 17 to rotate at the necessary slower rate. This relationship permits the use of a mechanically simple and inexpensive slip drive mechanism for the ribbon take-up receptacle. As previously noted, drive roller or meter 12 extends above the top cover portion 26, thereby allowing the drive roller or meter 12 to be manually rotated.

Although the above-described prior art ribbon drive means operates satisfactorily, it is relatively complicated and expensive. It is complicated from the viewpoint of consisting of numerous small parts, which must be individually fabricated and then be assembled by hand in the ribbon cartridge 10. It is expensive because of the number of parts involved and because of the time in labor involved in assembling the numerous parts in the ribbon cartridge 10 by hand rather than by machine. Because of the particular configuration of support and biasing of idler pressure roller 14, it is possible for tolerances and wear associated with pins 11 and 20 and levers 18 to cause a twisting or cocking of idler pressure roller 14 and thereby lower the efficiency and reliability of the ribbon drive means. The twisting or cocking of idler pressure roller 14 would result in the roller 14 not being aligned with the drive roller or meter 12, resulting in an unequal force distribution along the nip interface of rollers 12 and 14. The force could be high at the bottom of the interface and low at the top or vice versa, which results in the drive means to track either up or down and to eventually cause a failure by tracking the ribbon 16 out of the nip area.

It is desirable to provide a ribbon cartridge with an increased amount of ribbon therein, resulting in a cost reduction in unit manufacturing cost per thousand characters printed, together with a ribbon drive means capable of operating satisfactorily in the new environment. The new ribbon cartridge must fit the printer units presently handling the prior art ribbon cartridge and be suitable for automatic machine assembly to ensure a cost advantage. It is also desirable to have the ability to easily change drive ratio (drive gear to idler roller) to accommodate ribbons of different overstrike capabilities, thereby being able to drive, at the proper rate, anticipated future ribbons of higher overstrike capability.

Figure 2:
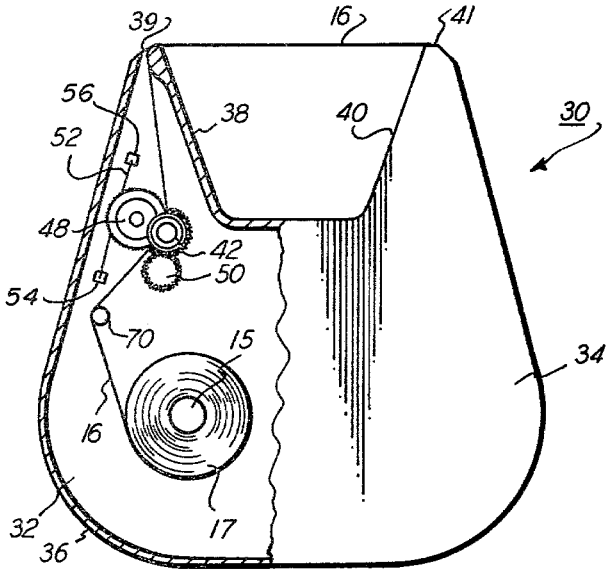
FIG. 2 is a fragmentary top plan view showing a ribbon cartridge and ribbon drive constructed in accordance with the teachings of the present invention.
Figure 3:
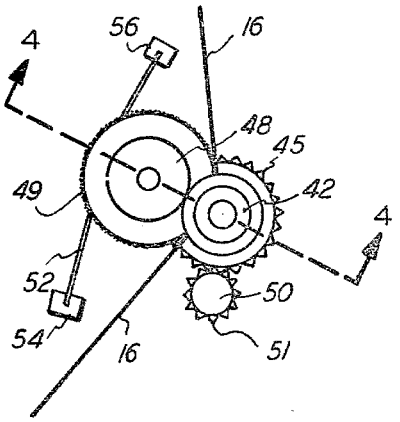
FIG. 3 is an enlarged portion of the present invention shown in FIG. 2.
Figure 4:
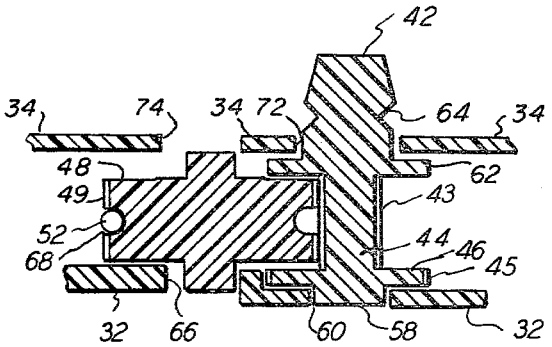
FIG. 4 is a cross-sectional view of FIG. 3 taken along lines 4—4.

FIGS. 2–4 represent a solution according to the instant invention, which provides for the elimination of the possible disadvantages set forth supra.

Referring now to FIG. 2, there is shown one embodiment of the ribbon drive means of the present invention in the ribbon cartridge 30. Ribbon cartridge 30 is mounted and carried by a carriage (not shown), which is mounted for linear movement transversely of a platen (not shown) for cooperating with a print mechanism (not shown) to provide printing capability in serial printer applications. Ribbon cartridge 30 comprises a bottom cover portion 32, a top cover portion 34 and a sidewall connecting portion 36. Two extensions or horns 38 and 40 contain openings 39 and 41 through which the ribbon 16 passes in its path of travel by the printing station located midway between horns 38 and 40.

With reference to FIGS. 2–4, the ribbon drive means comprises drive roller or meter 42 with serrations 43 formed on the outer perimeter of the columnar section 44 and gear teeth 45 formed on the lower flange portion 46, idler roller 48 with serrations 49 formed on the outer perimeter thereof, drive gear 50 with gear teeth 51 formed on the outer perimeter thereof, spring 52 and spring support posts 54 and 56. The lowermost portion 58 of driver roller or meter 42 is journaled for rotation in opening 60 of the bottom cover portion 32 of ribbon cartridge 30. On the upper portion of drive roller or meter 42, an extended ring-like section 62 is journaled for rotation with a coacting opening 72 in the top cover portion 34. An annular groove 64 is formed in the upper portion of drive roller or meter 42, said groove 64 coacting with an O-ring (not shown), which couples the rotational movement of drive roller or meter 42 to the ribbon take-up receptacle.

Drive gear 50 is journaled for rotation in a coacting opening (not shown) in the bottom cover portion 32 of ribbon cartridge 30 and is positioned essentially in the same plane as gear teeth 45 such that gear teeth 51 mesh with gear teeth 45. A star-type or cross-shaped coupling is formed in the bottom end portion of drive gear 50 to mate and cooperate with the drive shaft of the ribbon drive motor (not shown). The drive roller or meter 42 is offset from drive gear 50 in order to provide clearance for the increased amount of ribbon 16 to be received on the ribbon take-up receptacle as compared to the prior art ribbon cartridge 10 of FIG. 1.

Idler roller 48 is journaled for rotation in an elongated opening 66 of the bottom cover portion 32 and a corresponding opening 74 in the top cover portion 34 of ribbon cartridge 30. This allows idler roller 48 to be movable toward the longitudinal centerline of drive roller 42. Serrations 49 are formed in the outer perimeter of idler roller 48 and together with serrations 43, formed on the columnar section 44, intermesh and form a nip through which ribbon 16 passes as it travels from the ribbon supply means to the ribbon take-up receptacle. A groove 68 is formed in the outer periphery of the serrated portion or serrations 49 of idler roller 48 and is located at the center point of the serrations 49 as measured in the axial direction of idler roller 48. Biasing means to force idler roller 48 toward drive roller or meter 42 is provided by spring 52 located in groove 68. Spring 52 is supported at its ends by grooves formed in support posts 54 and 56. Posts (not shown) projecting downwardly from the top cover portion 34 coact with support posts 54 and 56 to maintain the ends of spring 52 in the grooves of support posts 54 and 56.

Ribbon guide post 70 is positioned between the ribbon drive means and the ribbon take-up receptacle at a predetermined location to provide and assure that ribbon 16 exits from the ribbon drive means at a predetermined angle of approximately 45° with respect to the entry line. Guide post 70 also tends to reduce the ribbon tension as measured at the nip area of the ribbon drive means and thereby tends to assist in reliable tracking.

The ribbon take-up receptacle comprises shaft 15 with integral hub 17 about which the ribbon 16 is wound subsequent to passing beyond the ribbon drive means. Shaft 15 is journaled for rotation in corresponding openings (not shown) in the bottom cover portion 32 and top cover portion 34. An annular groove (not shown) is formed in the portion of shaft 15 extending above the top cover portion 34; said groove is similar to groove 64 formed in drive roller or meter 42. An O-ring (not shown but similar to O-ring 19 depicted in FIG. 1) fits into the groove in shaft 15 and extends in a stretched condition to groove 64 in drive roller 42.

Regarding ribbon path with reference to FIG. 2, the ribbon 16 passes from the ribbon supply means (not shown), past a ribbon tensioning means (not shown), both of which are located in the right-hand portion of ribbon cartridge 30, out opening 41 and across the open space between horns 38 and 40 and then into opening 39 in horn 38. Once back inside the ribbon cartridge 30, ribbon 16 is directed into the nip formed by drive roller or meter 42 and idler roller 48. From said nip, ribbon 16 passes to and around the outboard side of guide post 70 and then to and around hub 17 upon which ribbon 16 is wound.

In operation, upon initiation of print commands to the printer (not shown), the ribbon drive motor (not shown) is activated causing drive roller 42 to be intermittently rotated in a counterclockwise direction (as viewed in FIG. 2) by the clockwise rotation of drive gear 50. The rotation of drive roller 42, together with idler roller 48 being biased toward and against drive roller 42, causes a gripping action on the ribbon 16 and subsequent movement of the ribbon 16 from the ribbon supply means (not shown) toward the ribbon take-up receptacle. The counterclockwise rotation of drive roller 42 results in a clockwise rotation of idler roller 48. The ribbon 16 is then wound around hub 17 by the movement of the O-ring (not shown but similar to O-ring 19 depicted in FIG. 1), which transfers the rotational movement of drive roller 42 to shaft 15 and integral hub 17 to take up any slack in the ribbon 16 occurring after the ribbon 16 passes the ribbon drive means. As the diameter of the wound ribbon 16 on the hub 17 increases, the O-ring is designed to start slipping about shaft 15, thereby permitting hub 17 to rotate at the necessary slower rate. Since drive roller 42 extends above the top cover portion 34, this extension allows the drive roller 42 to be manually rotated when necessary.

In view of the foregoing, it will be appreciated that this invention provides a ribbon drive means, which may be used to advantage in ribbon cartridges, and which is self-compensating for wear associated therewith. The present invention provides the advantage of cost as the bias means for the idler roller 48 comprises a straight round or flat rectangular piece of spring wire 52. The assembly technique is simple and straightforward in that the spring wire 52 is dropped straight into grooves in the spring support posts 54 and 56. This feature is important in considering automatic assembly by a machine. In addition, the load applied by the bias means to the idler roller 48 is always applied in the center of the idler roller 48; therefore, the idler roller 48 will adjust to the alignment of the drive roller or meter 42 or will align itself with the position of the drive roller or meter 42. This alignment capability provides equal force distribution from the top to the bottom of the nip between the drive roller 42 and the idler roller 48. This equal force distribution results in very good tracking and prevents the ribbon 16 from riding up or down with respect to the nip area.

The same principle of biasing the idler roller 48 against the drive roller 42 by applying the biasing force at the center of the idler roller 48 can be applied for singlestrike ribbons as well as multi-strike ribbons. The idler roller 48 and drive roller 42 used for multi-strike ribbon must be removed and are replaced by an idler roller 48 whose diameter is smaller than that used for multi-strike ribbon, while the drive roller 42 is replaced by one whose column section 44 has a diameter which is greater than that used for multi-strike ribbon. The serrations 43 and 49 for use on a single-strike ribbon are fewer in number and greater in depth than those used for a multi-strike ribbon, thereby causing the feeding of a greater amount of ribbon 16 for the same amount of rotation of drive roller 42.

Although the present invention has been described with reference to a presently preferred embodiment, it will be appreciated by those skilled in the art that various modifications, alternatives, variations, etc., may be made without departing from the spirit and the scope of the invention as defined in the appended claims.

What is claimed is:

1. In a ribbon cartridge having a top cover section, a bottom cover section, a sidewall connecting section, a ribbon and a ribbon take-up means, an improved ribbon drive means comprising:

a rotatably supported drive roller;

a rotatably supported idler roller, said idler roller having a groove formed in the periphery thereof, said groove being formed at the center of the longitudinal dimension; and means for biasing said idler roller against said drive roller to form a nip therebetween through which said ribbon is fed, said means for biasing being positioned to provide a single line of tangential contact in said groove of said idler roller to apply a bias force to the idler roller at the longitudinal center thereof, whereby the idler roller will align itself with the position of the drive roller to provide equal force distribution along the nip by pivoting around said single line of tangential contact.

2. The improvement of claim 1 wherein said means for biasing comprises a single straight spring member.

3. The improvement of claim 1 wherein said ribbon drive means includes ribbon guide means positioned for guiding the ribbon from the nip area at a predetermined angle with respect to a line formed by the path of travel of the ribbon between a point of entry of the ribbon to the ribbon cartridge and a point of contact of the ribbon with the nip area.

4. The improvement of claim 1 wherein said ribbon drive means includes means for coupling said drive roller to said ribbon take-up means in order to rotate said take-up means in the appropriate direction and at the appropriate speed to take up the ribbon fed through said nip.

5. The improvement of claim 1 wherein said drive roller has serrations formed in the outside surface area of the drive roller forming one portion of the nip.

6. The improvement of claim 1 wherein said idler roller has serrations formed in the outside surface area of the idler roller forming one portion of the nip.

* * * * *